United States Patent [19]

Vandergriff

[11] 4,310,949

[45] Jan. 19, 1982

[54] GIN RIB

[76] Inventor: Arvel L. Vandergriff, 1701 Heffner St., Corcoran, Calif. 93212

[21] Appl. No.: 54,819

[22] Filed: Jul. 5, 1979

[51] Int. Cl.[3] ..... D01B 1/08

[52] U.S. Cl. ..... 19/62 R

[58] Field of Search ..... 19/55 R, 64.5, 62 R

[56] References Cited

U.S. PATENT DOCUMENTS

| | | | |
|---|---|---|---|
| 2,133 | 6/1841 | Washburn | 19/62 R |
| 162,125 | 4/1875 | Trammell | 19/62 R |
| 171,991 | 1/1876 | Carver | 19/62 R |
| 206,847 | 8/1878 | Willians | 19/62 R |
| 280,498 | 7/1883 | Merritt | 19/62 R |
| 310,193 | 1/1885 | Edwards | 19/62 R |
| 417,849 | 12/1889 | Abernethy | 19/62 R |
| 823,439 | 6/1906 | Reynolds | 19/55 B |
| 1,300,162 | 4/1919 | Grimes | 19/62 R |
| 1,341,168 | 5/1920 | Cotton | 19/55 R |
| 1,455,685 | 5/1923 | Vardell | 19/55 R |
| 2,834,057 | 5/1958 | Raynor | 19/55 R |
| 3,135,021 | 6/1964 | Hennings | 19/56 |
| 3,277,536 | 10/1966 | Van Doorn et al. | 19/55 R |
| 3,340,575 | 9/1967 | Sievers | 19/55 R |

*Primary Examiner*—Louis Rimrodt

*Attorney, Agent, or Firm*—Huebner & Worrel

[57] ABSTRACT

A method and apparatus for accelerating removal of fully ginned seeds from a seed roll established in the roll box of an operating gin stand, whereby the ginning capacity of the stand is enhanced. The apparatus is characterized by improved ginning ribs interposed between saw blades of reduced spacing and characterized by a vertically oriented tail section for directing ginned seeds downwardly between the blades, and a seed extraction tube adapted to extend axially through a seed roll as it is established, said seed extraction tube being characterized by a plurality of apertures for accepting fully ginned seeds, and a conveyor for axially discharging the fully ginned seeds from the tube.

4 Claims, 10 Drawing Figures

Fig. 2
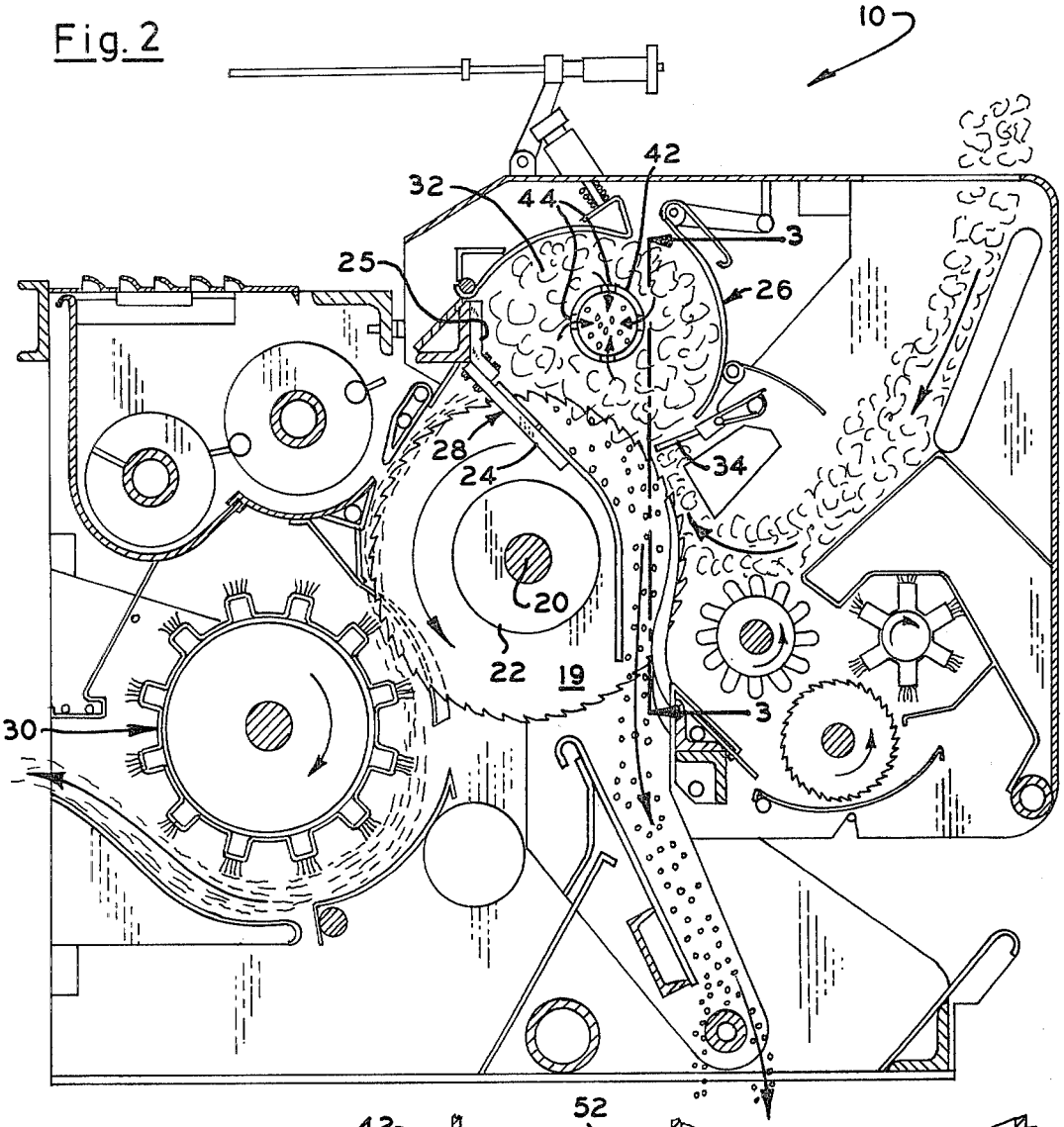
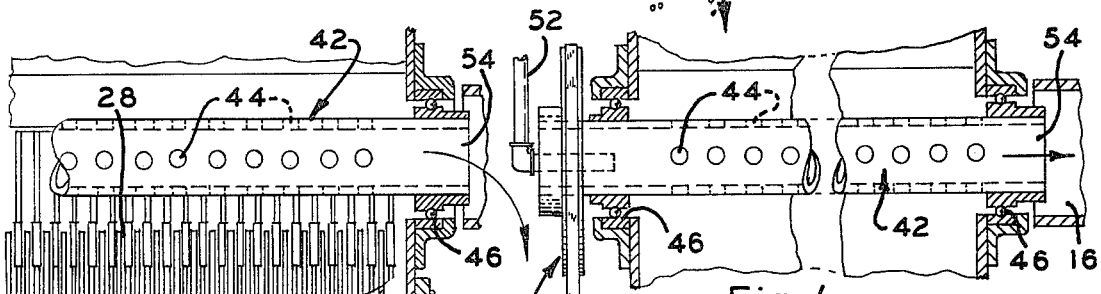
Fig. 4
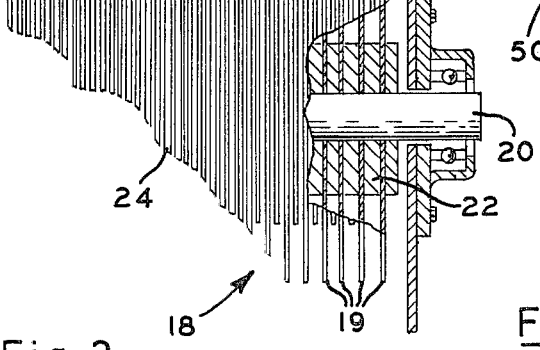
Fig. 3
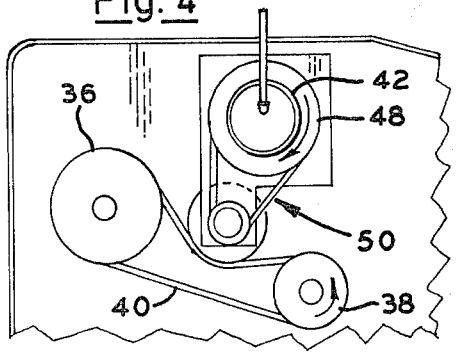
Fig. 5

Fig. 6
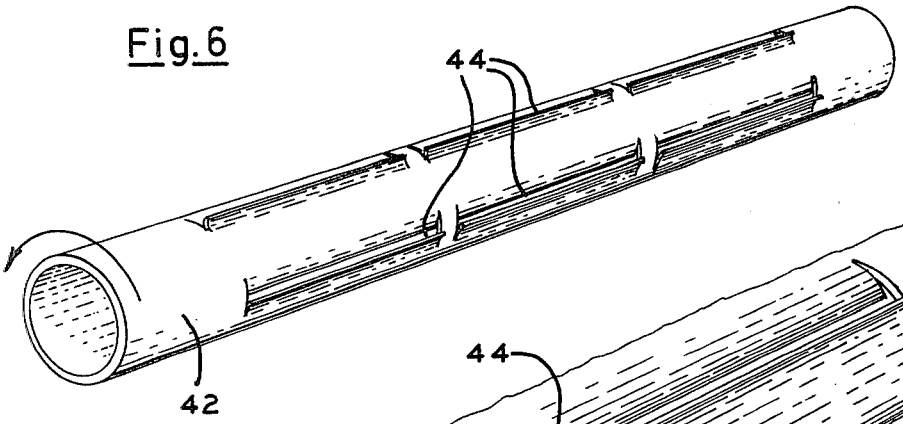
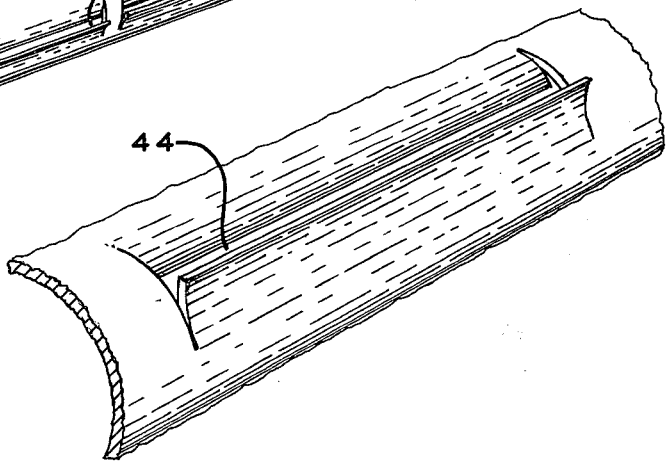
Fig. 7
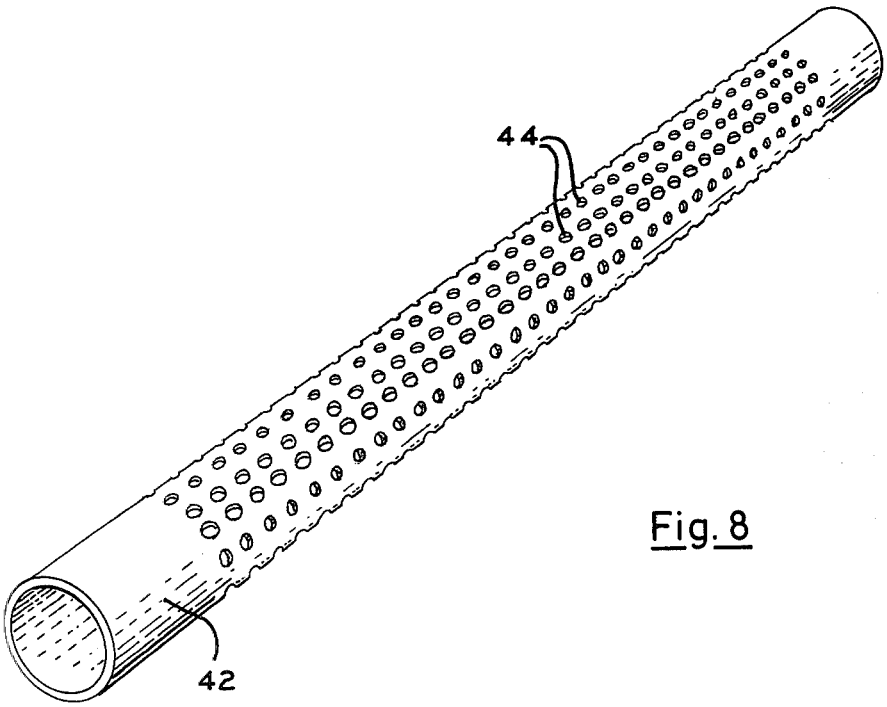
Fig. 8

GIN RIB

BACKGROUND OF THE INVENTION

The invention generally relates to an improved method and apparatus for removing seeds from a roll box of ginning stands at an accelerated rate, whereby the indigenous density of seed rolls is reduced and the capacity of ginning stands is increased.

As is well understood by those familiar with the design and operation of the so-called saw-type cotton gin, a gin stand consists of a plurality of coaxially spaced saw blades mounted in mutually spaced relation on a driven shaft and having projected therebetween elongated seed roll support members, commonly referred to as ginning ribs, or, more conveniently, ribs. The teeth of the saw blades extend between the ribs and engage the fibers of seed cotton as it is fed to the gin stand. The fibers are, in turn, pulled through ginning gaps, defined by the adjacent ribs, while passage of the seeds is precluded, or at least impeded, so that the seeds are considered to be rejected. The thus rejected seeds, along with fibers not engaged by the teeth, tend to accumulate in a comingled mass to establish a seed roll which is continuously rotated in response to the action of the saw blade acting thereon. The seed roll is confined by head plates and scrolls which collectively form a cavity, commonly referred to as a roll box. Of course, the lint or fibers carried by the blades through the ribs, is doffed or removed from the teeth and delivered to subsequent stations at which additional operations are performed.

The saw blades are of a suitable diameter. Some manufacturers currently select twelve inches while others select sixteen inches. The blades are characterized by a thickness of approximately 0.036 inches to 0.038 inches. The teeth preferably are die cut with the leading edge thereof paralleling a tangent to a circle whose center is common to the center of the saw blade and whose radius is two inches less than that of a twelve inch blade and three inches less than that of a sixteen inch blade. The surface speed of the rotating blades preferably is within a range of twenty-one hundred feet per minute to twenty-eight hundred feet per minute.

Heretofore, the gin ribs were made of cast iron, mounted on a rib rail located above the saw blades, and projected below the periphery of the rotating blades. A short section of the rib, at the region thereof adjacent the teeth of the saw blades, herein referred to as the ginning point, is hardened by placing a piece of steel in a mold and chilling the metal during the casting process. A short curved section of the rib is located above and below the ginning point and normally comprises a segment of a circle having a center located above the saw blades.

Currently, it is common practice to adjust the ginning rate of a gin stand to the discharge rate for ginned seed, rather than the rate at which lint removal from the saw blades occurs. This results from the fact that the factor limiting capacity is seed discharge, simply because of the inherent increase experienced in seed roll density as the population of seeds increases within the seed roll.

When the seeds become fully ginned, that is to say, when the lint fibers are removed from the seed down to the fuzzy cover, by the action of the saw teeth acting thereon, a release of the seeds from the seed roll is initiated. This results from the agitating effect of the saw blades acting on the seed roll. However, efforts to assure that the seeds be released only when they are completely ginned have been continuing since the early days of the saw-type gin.

In order to prevent the discharge of partially ginned seeds between the saw blades, the gin rib has been so designed that its curvature below the ginning point is only slightly below the top surface of the saw blade. This, heretofore, assures that any partially ginned seed which might fall from the bottom of the seed roll will be swept back up into the seed roll by the sagging fibers of the seed roll penetrating between the saw blades.

Of course, under most conditions many of the fully ginned seeds also are swept back into the surface of the rotating seed roll. For reasons well understood by those familiar with the operation of gin stands, fully ginned seed migrate toward and tend to accumulate at the core of a seed roll, while unginned and partially ginned seed migrate toward the surface of the roll.

As is well known, the principle discharge point for ginned seed heretofore has been located at the sag in the seed roll, located in a region established adjacent the saw blades. It has been, in practice, found that the sharper the sag angle the greater the seed discharge rate. The sharpness of the sag angle is controlled, at least in part, by the contour of the ribs. Consequently, the contour of the ribs, in large measure, serve to limit seed discharge rates for seed rolls established in roll boxes of conventional gin stands.

For reasons believed to be apparent, the greater the seed density of a seed roll, the greater will be the power requirements for the gin stand, particularly the power requirements of the saw shaft. Thus, increased density results in decreased capacity at a given level of power input. Moreover, it is well known that seed roll density adversely affects the grade or quality of the lint since the lint is caused to kink, knot, etc.

It is therefore the general purpose of the instant invention to provide an improved method and apparatus for enhancing the rate of removal of fully ginned seeds from a seed roll supported by the saw blades in the roll box of a gin stand, whereby power requirements are reduced and gin capacity, as well as the quality of the resulting lint, is substantially increased.

OBJECTS AND SUMMARY OF THE INVENTION

It is therefore an object of the instant invention to provide an improved method for removing fully ginned seeds from the seed roll of an operating gin stand.

Another object is to provide an improved apparatus for removing fully ginned seeds from the seed roll of an operating gin stand.

Another object is to provide an improved method and apparatus for removing fully ginned seeds from the seed roll of an operating gin stand at a rate sufficient to permit use of closer saw spacing, whereby greater economy and increased ginning capacity is accommodated without an attendant increase in power requirements.

Another object is to provide means for reducing the indigenous density of seed rolls in a roll box of an operating gin stand.

Another object is to provide in a gin stand a seed extractor for removing seed from the core of a seed roll confined in the roll box thereof.

Another object is to provide in the roll box of a gin stand, means for collecting and axially discharging fully ginned seeds from the core of a seed roll, whereby the density of the seed roll is reduced and the capacity of the gin stand is enhanced, all without an attendant substantial increase in power requirements.

Another object is to provide for use in a gin stand an improved ginning rib characterized by an enhanced longevity.

Another object is to provide in a gin stand an improved ginning rib which is particularly suited for accommodating closer saw spacing while simultaneously enhancing seed discharge radially from the sag of a seed roll.

These, together with other objects and advantages are achieved through the use of an improved method and apparatus particularly adapted for axially extracting fully ginned seeds from the core of a seed roll, while simultaneously enhancing the discharge rate from the sag of the seed roll, as will become more readily apparent by reference to the following description and claims in light of the accompanying drawings.

BRIEF DESCRIPTION OF THE DRAWINGS

FIG. 2 is a vertically sectioned end elevational view of the gin stand shown in FIG. 1, illustrating a seed extraction tube and an associated improved ginning rib, which collectively embody the principles of the instant invention.

FIG. 3 is a fragmented, partially sectioned front elevational view of a saw cylinder, as shown in FIG. 1, more clearly depicting the positional relationship of the seed extraction tube and ginning ribs shown in FIG. 2.

FIG. 4 is a fragmented, sectioned view depicting a rotational support and drive coupling for the seed extraction tube shown in FIG. 3.

FIG. 5 is a fragmented end elevational view of the gin stand, on a reduced scale, illustrating a drive mechanism employed in imparting rotation to the seed extraction tube.

FIG. 6 is a perspective view of the seed extraction tube illustrating one form of seed segregating apertures provided for the tube.

FIG 7 is a fragmented perspective view depicting one of the apertures, on an enlarged scale, shown in FIG. 6.

FIG. 8 is a perspective view of another seed extraction tube illustrating another form of seed segregating apertures.

DESCRIPTION OF THE PREFERRED EMBODIMENTS

Figure 1:
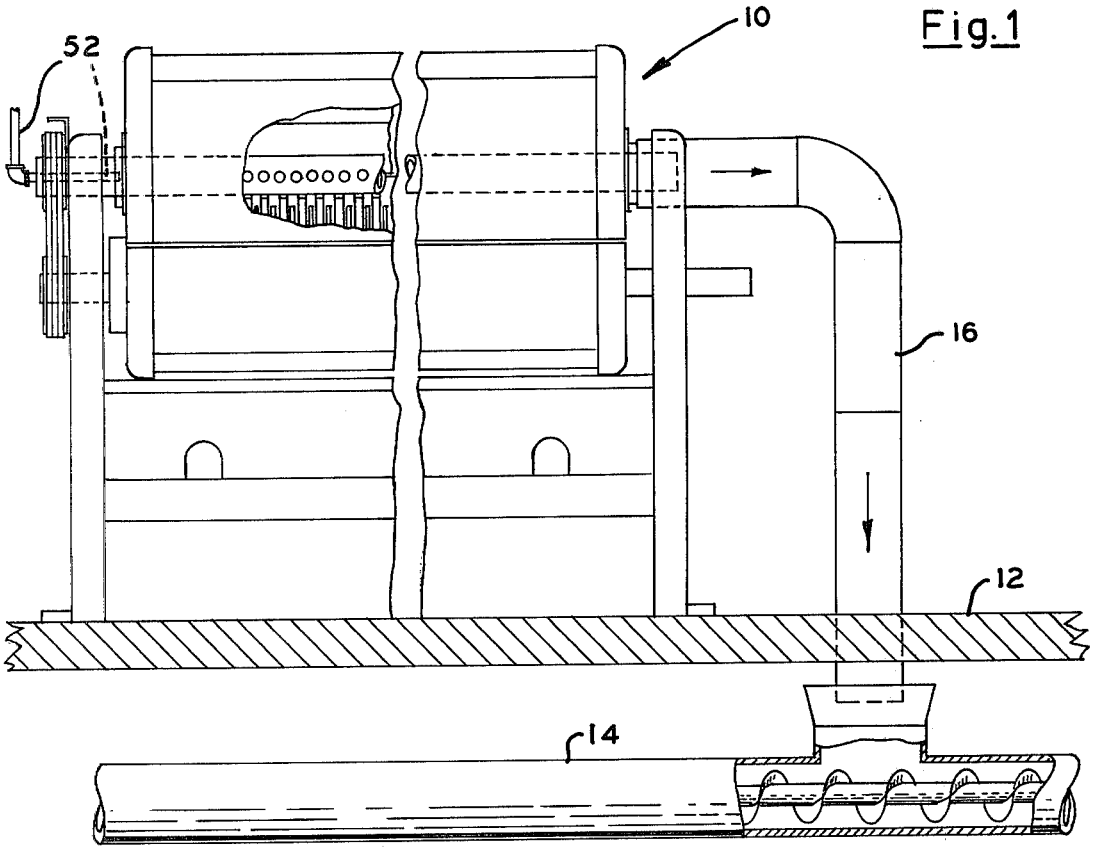
FIG. 1 is a partially sectioned, fragmented elevational view of a gin stand having included therein seed removal means embodying the principles of the instant invention.

Referring now to the drawings, with more particularity, wherein like reference characters designate like or corresponding parts throughout the several views there is shown in FIG. 1 a gin stand, generally designated 10.

As a practical matter, it is to be understood that the gin stand 10 comprises one of a plurality of similar gin stands which collectively form a plant, often referred to as a "gin", the capacity of which is determined by the capacity of the individual gin stands, as well as the total number thereof.

As shown in FIG. 1, the gin stand 10 is mounted on a floor 12 and is connected with a seed conveyor 14 through a suitable seed delivery circuit 16, the purpose of which is hereinafter more fully described. Turning now to FIG. 2, it can be seen that the gin stand 10 comprises a so-called saw-type gin stand. The stand 10 includes a saw chamber within which is disposed a saw cylinder 18, FIG. 3, comprising a plurality of individual gin saw blades 19 mounted on a common driven saw shaft 20 and separated by spacer blocks 22. As a practical matter, it is to be understood that seed cotton is introduced to the gin stand 10 via a breast huller, not designated, preferably at a regulated rate. From the breast huller the seed cotton is directed into the saw chamber, as best shown in FIG. 2.

Interposed between each pair of saws 19 of the cylinder 18, there is projected a ginning rib 24, FIG. 3, disposed in close proximity to each of the saw blades 19, and supported by a common rib rail 25, FIG. 2. Located immediately above the gin saw cylinder 18 and ribs 24 is a roll box generally designated 26, into which the seed cotton is conveyed by the upwardly progressing teeth of the blades 19.

A ginning point 28 is established near the top of each of the saw blades 19 and at the point at which the saw blades pass between the ginning ribs 24. At this point, of course, passage of the seed between the ginning rib 24 and the blade 19 is precluded, due to the width of the ginning gaps, or the spacing of the ginning ribs relative to the saw blades. Thus the seeds are rejected as the lint is pulled through the gaps by the saw teeth. The lint ultimately is doffed by a doffing mechanism, generally designated 30, the details of which form no part of the instant invention.

Of course, some of the lint cotton is stripped from the saw blades as it is pulled through the seed roll. This cotton tends to join and become comingled with the rejected seed, as the seed roll is caused to turn in the roll box 26 in response to the saw teeth acting thereon. Thus, partially ginned seed, fully ginned seed and lint comingle with the unginned seed cotton as it is caused to rotate in the seed roll and this is continuously exposed to the effects of the saw teeth, so that all lint ultimately is removed from the seed roll, and the fully ginned seeds discharged from the roll box.

Preferably, the roll box 26 is given a cross-sectional configuration of an oval shape. However, since the details of the roll box form no part of the claimed invention, a detailed description thereof is omitted in the interest of brevity. It is to be understood, of course, that within the roll box 26 there is established a rotating seed roll 32 which is supported, at least in part, by the saw cylinder 18, ginning ribs 24, and a plurality of fingers designated 34. The fingers 34 are so positioned as to support the seed roll at the "sag" thereof, or the point at which a rupture of the seed roll occurs for permitting seed to gravitate radially from the seed roll 32.

In practice, the saw shaft 20 is driven by an electrical motor, not designated, connected in driving relation to a drive sheave 36 which is, in turn, connected with a drive sheave 38 through a belt coupling 40. Since the details of the drive mechanism also form no part of the claimed invention, a detailed description thereof also is omitted in the interest of brevity. However, it is to be understood that the surface speed of the rotating saw blades is in the range of twenty-one hundred feet per minute to twenty-eight hundred feet per minute and that the diameter of the blades may be twelve, sixteen, or even eighteen inches, as desired.

In operation, only fully ginned seeds migrate to the core of the seed roll 32. Therefore, removal of the fully ginned seeds from the core is desired. In order to remove the seed from the core of the seed roll 32, there is provided a seed extraction tube 42 extended axially through the roll box. The seed extraction tube 42 is of a cylindrical configuration and includes about its wall a series of apertures 44. The apertures are suitably dimensioned as to accommodate passage of fully ginned seed to the interior of the tube while rejecting partially ginned seeds. As best illustrated in FIG. 4, the seed extraction tube 42 preferably is supported for rotation by a race of bearings 46 located at each of its opposite ends, FIG. 4. Mounted on the tube 42 in any suitable fashion, there is a sheave 48, which is, incidentally, connected with the belt 40 via a sheave and belt coupling, generally designated 50, FIG. 5. Preferably, the extraction tube 42 is driven by the belt 40 at a rate differing from the rate at which the seed roll 32 is caused to rotate in response to the saws acting thereon. The rate of rotation for the seed extraction tube 42 may be greater or even lesser than that of the seed roll. The surface speed differential is deemed highly desirable, if not necessary, in order to break seed loose from the mass of the seed roll and permit them to enter the apertures 44 defined in the wall of the tube 42. In actual practice, small clumps of seed will project through the apertures 44 and yet still cling to the mass of the seed roll so that the speed differential becomes instrumental in separating the seed from the mass. Where desired, the speed of a seed roll is in the range of 80 r.p.m. to 100 r.p.m. thus making a desirable speed for the seed extraction tube 42 of approximately 70 r.p.m. or, 125 r.p.m., depending upon whether the seed extraction tube 42 is to be rotated at a greater or lesser rate than the rate at which the speed roll 32 is caused to rotate.

With reference to FIGS. 6 and 7, it can be seen that the apertures 44 may assume the configuration of slotted openings, preferably about three-eighths inch wide. However, as best shown in FIG. 8, the apertures 44 may assume a configuration of round holes, approximately three-eighths inch to seven-sixteenths inch diameter, preferably arranged in an in-line configuration. The specific size of the openings formed in the seed extraction tube 42 is not deemed critical, except as they pass over the surface of the gin saw cylinder 18 and near the head plates, not designated, for the roll box 26. The head plates and saws tend to cause partially ginned seeds to reach the core of the seed roll and hence force the seed through the apertures.

As shown in FIGS. 6 and 7, the apertures 44 can be much larger if the trailing edge of the opening is flared, and/or the leading edge is depressed to prevent the action of the saw blades from pushing the ginned seeds into the apertures and thence into the seed extraction tube. Also, in practice, it has been found desirable that the apertures 44 be spaced approximately three-eighths of an inch apart, for a distance of a few inches from the head plates. A satisfactory arrangement is to provide no openings within eight to ten inches of the head plates for the roll box.

While not shown, it should be understood that the seed extraction tube 42 is, where so desired, arranged in a stationary configuration so that the seed roll 32 is, in operation, rotated therearound. In such instances, no openings are provided in the periphery of the seed extraction tube at about 90° C. of the circumference of the tube above the saw blade. This produces a good seed discharge rate, but under some adverse conditions the added resistance of the stationary tube tends to cause the seed roll to stop turning. When a stationary seed extraction tube is employed, any pattern for the apertures may be used as long as the tube retains a reasonable rigidity. The size of the apertures 44 is not readily limited since, in operation, only fully ginned seeds tend to reach this area of the seed roll.

Finally, although not shown, the extraction tube 42 is, where desired, mounted for floating displacement in vertical directions.

In order to effect removal of fully ginned seeds from the extraction tube 42, there is connected at one end thereof a pressure source, not shown. While a vacuum serves satisfactorily, a pneumatic jet 52 is shown connected to a source of pressurized fluid such as air or the like. It can be seen that the jet 52 is directed axially through the seed extraction tube 42 so that the fully ginned seeds are blown axially from the tube 42 through a seed discharge orifice 54 located at the opposite end of the extraction tube, FIG. 4. The orifice 54, in turn, communicates with the seed delivery conduit 16 so that the seed discharged from the seed extraction tube 42 ultimately is delivered to the seed conveyor 14, via the conduit and conveyed from the gin stand 10 in any suitable manner.

The source of the stream of air delivered by the jet 52 axially through the seed extraction tube 42, of course, has a capacity of creating a suitable velocity. As a practical matter, where a vacuum is employed for this purpose, a velocity of 4,000 feet per minute may be achieved.

It should now be apparent that because the seed extraction tube 42 is extended axially through the roll box 26 of that region of the seed roll to which fully ginned seeds migrate, the capacity for the removal of seeds from the seed roll 32 greatly has been enhanced, all without requiring a substantial increase in the level of power to be supplied the gin stand. Because of the increased capacity of the gin stand, closer spacing of the saw blades 19 may be resorted to, whereby a potential for even greater capacities exist.

Figure 9:
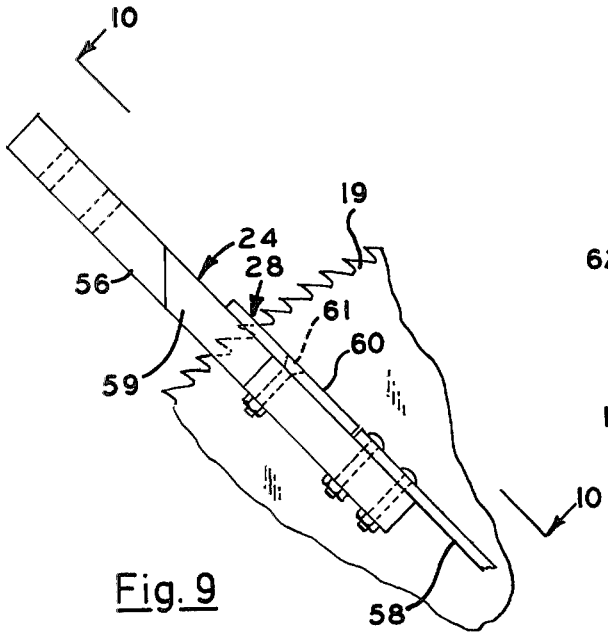
FIG. 9 is a side elevational view of a ginning rib, adjacently related to a gin saw, as depicted in FIGS. 2 and 3, illustrating the positional relationship of the ginning section at a ginning point.
Figure 10:
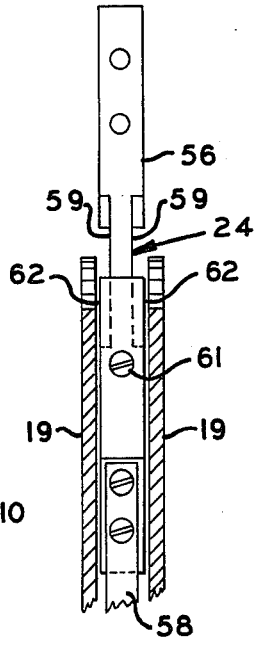
FIG. 10 is a fragmented partially sectioned view taken along line 10—10 of FIG. 9.

In order to further enhance the overall capacity of the gin stand 10, to discharge ginned seed from the seed roll 32, each of the ginning ribs 24 is provided with a linear body segment 56, which forms a support for the seed roll, and a tail segment 58 connected thereto, FIGS. 9 and 10. The tail segment 58 is, in practice, seated upon and bolted to the upper surface of the body segment or support 56. A short section of the body segment above the ginning point 28 is milled to a width of ¼ inch for thus providing a 5/16 inch relief 59 between the rib and each of the saw blades 19 in order to allow knotted fibers or groups of fibers to be pushed upwardly and released to be rejoined with the seed roll 32 at its surface.

A ginning section 60 is mounted on top of the rib for establishing a ginning gap 62, FIG. 10, between each of its opposite sides of the adjacently disposed blades 19. Each ginning rib 24 includes no upward curve below the ginning point 28, and, as shown, the ginning section 60 is inclined with respect to vertical, at an angle substantially equal to the angle at which the leading edge surface of each tooth is inclined as it passes the ginning point 28. As shown in the drawings, the ginning section 60 is inclined at forty-eight degrees off the vertical and extends parallel to a tangent to a circle concentric with the saw shaft 20 and of a diameter less than the diameter of the saw. At the tangent, the trail segment 58 of the ginning rib turns vertically downwardly to provide a steep angle for the ginned seeds to gravitate and thus discharge over the surface of the rib at an accelerated rate.

The body segment 56 of each of the ribs 24 is cut from a nine-sixteenths inch key stock and is bolted to the rib rail 25 and extended at an inclination between the saw blades, as best shown in FIG. 2. The lower end of the body segment 56 preferably is finished to a width of three-eights of an inch in order to provide a base for mounting the ginning section 60 employing a mounting bolt 61. Thus the saw blades 19 are spaced apart nine-sixteenths of an inch leaving a three-sixteenths inch between the body segments 56 and the adjacent saw blades.

The ginning section 60 functions as a wear block and comprises a piece of hardened steel three-sixteenths of an inch thick, seven-sixteenths of an inch wide and one and seven-eighths inch long. A symmetrical bolt arrangement is employed so that the ginning section 60 can be turned end-for-end to present new wear surfaces as needed. Also, the section can be turned over for same purposes, making new wear surfaces available before the small inexpensive body segment 56 must be replaced. As a practical matter, the bolt 61, where so desired, comprises a shoulder bolt so that with the bottom thereof is seated against the support, whereby, the ginning section is free to pivot on the body segment 56 of the rib. However, pivotal motion of the ginning section 60 is limited by the obstructing relationship of the tail segment 58, see FIGS. 9 and 10. While a shoulder bolt is particularly suited for facilitating pivoted motion, such motion can be facilitated employing a conventional bolt or screw, as shown. In any event, the pivotal motion thus facilitated accommodates a relief of pressure resulting from an accumulation of fibers between the adjacent blade and the rib. It is to be understood that both end portions of the ginning section 60 may include a taper, not shown, for achieving a similar result, even in instances where the section 60 is rigidly mounted on the body segment 56.

The ginning point 28, or the point at which the teeth of saw blades 19 pass the ginning sections 60 with loads of fiber, may experience a development of considerable pressures, exerted by the fibers on the edge of the ginning sections. From the point of penetration of the rib gap by the leading edge of a saw blade tooth to the top of the ginning section is, in practice, three-quarters of an inch. This is substantially shorter than the ginning sections of the ribs heretofore employed and permits fibers which are pushed into the ginning gap 62, but which are not attached to the teeth of the saw blades, to be pushed a shorter distance to a release point defined by the relief 59. Knots of tangled fibers thus are not permitted to wedge before reaching the relief point, and, of course, the ginning section 60 is permitted to pivot slightly about the mounting bolt 61 for thus further assuring an avoidance of choking. The clearance provided between the lower end of the ginning section 60 and the upper end portion of the tail segment 58 is slight but sufficient to permit the desired pivotal motion.

In view of the wide relief 59 provided at the end of the ginning section 60 made possible by the strength of the steel section, and the floating of the ginning section 60, permits heavy wads of fibers to move upwardly without wedging. Moreover, by mounting the ginning section on the top of the body segment 56, rather than inserting it as an insert into the body section, the necessary relief for hard tangled groups of fibers is provided at the top of the rib gaps. Thus, a non-choking effect for the ribs is realized, accompanied by a reduction in the tendency to experience friction fires.

OPERATION

While it is believed that in view of the foregoing description of the device its operation readily will be understood, it will, for the sake of completeness, be reviewed at this point.

With the gin stand 10 assembled in the manner hereinbefore described, seed cotton is introduced into the breast huller thereof for delivery to the saw cylinder 18. The seed cotton is picked up by the teeth of the individual saws 19 of the saw cylinders 18 and transported upwardly to the ginning point 28, at which point the seeds are rejected and thus are stripped from the lint cotton as their passage through the ginning gaps 62 is precluded.

Continued rotation of the saw blades and continued introduction of seed cotton to the breast huller initiates an ultimate development of a seed roll 32 within the roll box. Continued operation of the saw cylinder 18 permits the saws to impart rotary motion to the thus formed seed roll, while simultaneous further ginning of seeds occurs. Continued operation causes the fully ginned seeds to migrate toward the center or core of the seed roll.

Once development of the seed roll is complete, a rupture at the sag portion thereof, immediately above the fingers 34, occurs for permitting fully ginned seeds located near the periphery of the seed roll to drop vertically across the vertically oriented tail segments 58 of the ginning ribs 24. Of course, the fully ginned seeds which are caused to migrate to the center of the core enter the seed extraction tube 42 via the apertures 44. Where the apertures 44 are of an elongated configuration, flanges existing along the trailing edges and/or depressions existing along the leading edges prevent the saws from forcing partially ginned seeds through the apertures. The seed extraction tube 42 is, as aforedescribed, preferably rotated at a rate greater, or lesser, as desired, than the rate at which the seed roll 32 is being rotated by the saws 19. Thus the seeds are caused to be separated from the lint as they enter the apertures 44.

A standing stream of air is directed axially through the seed extraction tube 42, by the pneumatic jet 52, which serves to discharge the fully ginned seeds axially into the seed delivery conduit 16 for subsequent gravitation to the seed conveyor 14. Thus the fully ginned seeds are extracted from the core of the seed roll.

Continued rotation of the blades 19, of the gin saw cylinder 18, causes lint cotton to be drawn through the ginning gaps 62. However, in the event knotted fibers are drawn by the teeth into the gap 62, they are permitted to move upwardly along the ginning section 60 to the relief 59, whereupon they are released from the ginning section for return to the surface of the adjacent seed roll 32. In the event pressure develops in the ginning gaps 62 in response to a collection of tangled groups of fibers, pivoting of the ginning sections 60 occurs thus to release the pressure slightly for thereby releasing the tangled groups of fibers for permitting them to pass through the ginning gaps and/or pass upwardly to the relief 59 for ultimate return to the rotating surface of the seed roll 32.

As should be apparent, the simplicity and symmetry of the ginning section 60 permits the ginning sections 60 to be reversed about orthogonal axes for thus accommodating presentation of new wear surfaces to the blades 19, at the ginning points 28, without requiring that a totally new rib be inserted. Thus the longevity of the ribs greatly is enhanced without reducing the efficiency of the improved ribs.

In view of the foregoing, it should be apparent that the invention hereinbefore described serves to enhance seed discharge from seed rolls and thus enhances the overall capacity of the gin stand 10, without an attendant substantial increase in power requirements.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. An improved ginning rib for use in a high-capacity gin stand adapted to be mounted between closely related circular saw blades of a ginning saw cylinder, including:

A. a linear body segment having a planar upper surface extended throughout its length;

B. a ginning section comprising a pivotally supported bar of hardened steel having planar surfaces and characterized by a substantially rectangular cross-sectional configuration and a wear durability greater than the wear durability of said linear body; and C. an angulated tail segment seated on the upper surface of and removably connected to said linear body segment in juxtaposed relation with one end of said bar, said tail segment being characterized by an end surface so positioned relative to said bar as to engage the adjacent end surface of the bar as pivotal motion is imparted thereto for limiting the throw of pivotal displacement imparted to the bar.

2. An improved ginning rib as defined in claim 1 further comprising mounting means for releasably coupling said bar to said linear body segment of said rib for facilitating top-to-bottom and end-to-end repositioning of the bar relative to said linear body segment.

3. An improved ginning rib as defined in claim 2 wherein said mounting means comprises a mounting bolt symmetrically related to said bar and defining therefor a pivotal axis.

4. An improved ginning rib comprising:

A. a first elongated, metallic bar adapted to be interposed between a pair of closely spaced ginning saws and mounted on a rib rail in an inclined disposition relative to a ginning point, said first elongated bar being characterized by a planar upper surface throughout its length;

B. a pivotal ginning section seated on the upper surface of said first bar comprising a second elongated, metallic bar of a rectangular, cross-sectional configuration and characterized by six substantially planar external surfaces, said second bar being characterized by a greater wear durability than that of said first bar;

C. coupling means joining said second bar to said first bar and supporting said second bar for pivotal displacement comprising a mounting bolt symmetric to said second bar and normally related to the upper surface of said first bar supporting said second bar for pressure-induced pivotal displacement; and D. a curved body having a linear segment seated on the upper surface of said first bar and releasably coupled thereto, the linear segment of said curved bar being characterized by an end surface disposed in spaced juxtaposition with one end surface of said second bar and adapted to engage said one end surface of the second bar for limiting the throw of pivotal displacement imparted thereto.

* * * * *

UNITED STATES PATENT AND TRADEMARK OFFICE

CERTIFICATE OF CORRECTION

PATENT NO. : 4,310,949

DATED : January 19, 1982

INVENTOR(S) : Arvel L. Vandergriff

It is certified that error appears in the above-identified patent and that said Letters Patent are hereby corrected as shown below:

Column 4, line 43, change "this" to ---thus---;

Column 6, line 37, change "of" (first occurance) to ---or---; and

Column 7, line 3, change "trail" to ---tail---.

Signed and Sealed this

*Sixth* Day of *April 1982*

|SEAL|

*Attest:*

GERALD J. MOSSINGHOFF

*Attesting Officer*

*Commissioner of Patents and Trademarks*